US006523716B2

(12) United States Patent
Goldberg et al.

(10) Patent No.: US 6,523,716 B2
(45) Date of Patent: Feb. 25, 2003

(54) NEWSPAPER VENDING MACHINE

(75) Inventors: Neil J. Goldberg, San Francisco; Steven Harry Nersesian, Oakland; Imraan Aziz, Stanford; Lars Jonas Furberg; Kenneth Sm Ling, both of San Francisco; Gerard Marnien, Chino; Bradley C. Dinkmeyer, Encino; Brian Marcroft, Norwalk, all of CA (US)

(73) Assignee: The Times Mirror Company, Los Angeles, CA (US)

( * ) Notice: Subject to any disclaimer, the term of this patent is extended or adjusted under 35 U.S.C. 154(b) by 0 days.

(21) Appl. No.: 09/899,903

(22) Filed: Jul. 5, 2001

(65) Prior Publication Data

US 2001/0054619 A1 Dec. 27, 2001

Related U.S. Application Data

(63) Continuation of application No. 09/346,112, filed on Jun. 30, 1999, now abandoned.
(60) Provisional application No. 60/091,149, filed on Jun. 30, 1998.

(51) Int. Cl.[7] ..... A47F 1/04
(52) U.S. Cl. ..... 221/155; 221/192
(58) Field of Search ..... 221/155, 191, 221/192, 152, 266, 196, 241, 259, 279, 226; 312/351, 351.1, 61, 71

(56) References Cited

U.S. PATENT DOCUMENTS

| | | | | |
|---|---|---|---|---|
| 557,974 | A | 4/1896 | Conlin et al. | |
| 1,229,062 | A | 6/1917 | Geesy | |
| 1,597,743 | A | 8/1926 | Walz | |
| 2,808,625 | A | 10/1957 | Wilkinson | 20/16 |
| 2,996,754 | A | 8/1961 | Ziegler et al. | 16/52 |
| 3,335,451 | A | 8/1967 | Patriquin | 16/52 |
| 3,425,596 | A | 2/1969 | Marczak et al. | 221/77 |
| 3,884,330 | A | 5/1975 | Chalabian | 194/59 |
| 4,049,106 | A | 9/1977 | Chalabian | 194/1 B |
| 4,067,477 | A | 1/1978 | Chalabian | 221/1 |
| 4,106,609 | A | 8/1978 | Kaspar | 194/1 B |
| D273,020 | S | 3/1984 | Chalabian | D20/6 |
| D273,021 | S | 3/1984 | Chalabian | D20/6 |
| D273,022 | S | 3/1984 | Chalabian | D20/6 |
| D273,023 | S | 3/1984 | Chalabian | D20/8 |

(List continued on next page.)

*Primary Examiner*—Kenneth W. Noland
(74) *Attorney, Agent, or Firm*—Christie, Parker & Hale, LLP

(57) ABSTRACT

A newspaper vending machine provides a display newspaper at a height and angle resembling a lectern so that a customer can easily read the display paper from a standing position. The newspaper vending machine comprises a housing having a front wall, a back wall, two side walls, a top, and a bottom, and a storage compartment therein for storing a plurality of newspapers. The top of the housing is generally curved downwardly toward the front wall. A portion of the top in contact with the back wall is higher than the portion of the top in contact with the front wall. A viewing area is provided within the top of the housing through which at least a part of a display newspaper can be viewed. A newspaper display rack is mounted within the top of the housing under the viewing area at an angle from vertical ranging from about 40° to about 70°. The display rack has an upper surface through which at least a part of the display newspaper can be viewed.

24 Claims, 13 Drawing Sheets

U.S. PATENT DOCUMENTS

| | | | | |
|---|---|---|---|---|
| 4,465,207 | A | 8/1984 | Chalabian | 221/241 |
| 4,576,271 | A | 3/1986 | Chalabian | 194/233 |
| D286,061 | S | 10/1986 | Chalabian | D20/6 |
| D287,030 | S | 12/1986 | Chalabian | D20/6 |
| D287,143 | S | 12/1986 | Chalabian | D20/6 |
| D287,513 | S | 12/1986 | Chalabian | D20/6 |
| D287,605 | S | 1/1987 | Chalabian | D20/6 |
| D289,664 | S | 5/1987 | Chalabian | D20/6 |
| 4,707,038 | A | * 11/1987 | Voegeli | 221/226 |
| 4,718,532 | A | 1/1988 | Chalabian | 194/350 |
| D297,650 | S | 9/1988 | Chalabian | D20/6 |
| 4,828,097 | A | 5/1989 | Kresta et al. | 194/227 |
| 4,844,567 | A | 7/1989 | Chalabian | 312/139 |
| 4,919,250 | A | 4/1990 | Olson et al. | 194/248 |
| 5,143,251 | A | 9/1992 | Kahanek et al. | 221/152 |
| 5,216,907 | A | 6/1993 | Ullmann | 70/159 |
| 5,313,725 | A | 5/1994 | De Vassie | 40/312 |
| 5,318,195 | A | 6/1994 | Kahanek et al. | 221/152 |
| 5,458,232 | A | 10/1995 | Novak et al. | 206/45.16 |
| D408,862 | S | 4/1999 | Berchenhoff et al. | D20/6 |

* cited by examiner 113
92
10
26
82
72
79
82
75
80
70
24
28

NEWSPAPER VENDING MACHINE

CROSS-REFERENCE TO RELATED APPLICATION

This application is a continuation of U.S. patent application Ser. No. 09/346,112, filed Jun. 30, 1999 now abandoned, which claims priority of U.S. Provisional Patent Application No. 60/091,149, filed Jun. 30, 1998, the entire disclosure of which is incorporated herein by reference.

BACKGROUND OF THE INVENTION

Newspaper vending machines, also known as newsracks, have been in existence for decades. Generally, these machines include a cabinet having a lockable door that can be opened when the customer inserts a predetermined coin combination into the machine. When the door is opened, the user can remove a newspaper from the cabinet. Additionally, a display newspaper is typically provided in a vertical position on the machine so that the customer can see the newspaper before making a purchase.

Such machines, however, traditionally suffer from a number of problems. First, when the door is opened, the user is free to remove more than one newspaper from the cabinet because of the placement of the papers. This problem can be compounded if the door does not have an automatic closing mechanism. However, traditional newsracks that have an automatic mechanism for closing the door suffer from the further problem that the door can close too fast when released by the customer, potential causing injury to the customer's hand if it is not removed from the doorway quickly enough.

Additionally, such machines are generally not very tall due to height restrictions imposed on such machines in a large number of cities throughout the country. When a display newspaper is provided in a vertical position on such machines, it is difficult for a user to read the display newspaper from a standing position.

SUMMARY OF THE INVENTION

The present invention is directed to a newspaper vending machine the overcomes the aforementioned problems associated with traditional newspaper vending machines. In one embodiment, the invention is directed to a newspaper vending machine that provides a display newspaper at a height and angle resembling a lectern so that a customer can easily read the display paper from a standing position. The newspaper vending machine comprises a housing having a top, a bottom, and a storage compartment therein for storing a plurality of newspapers. A viewing area is provided within the top of the housing through which at least a part of a display newspaper can be viewed. The newspaper vending machine further comprises means for mounting the display newspaper so that at least a portion of the display newspaper can be seen through the viewing area and so that the newspaper is mounted at an angle from vertical ranging from about 40° to about 70°.

In another embodiment, the newspaper vending machine comprises a housing and viewing area as described above. The newspaper vending machine further comprises a newspaper display rack mounted within the housing under the viewing area at an angle from vertical ranging from about 40° to about 70°. The display rack has an upper surface through which at least a part of the display newspaper can be viewed.

In yet another related embodiment, the newspaper vending machine comprises a housing having a front wall, a back wall, two side walls, a top, and a bottom, and a storage compartment therein for storing a plurality of newspapers. The top of the housing is generally curved downwardly toward the front wall. A portion of the top in contact with the back wall is higher than the portion of the top in contact with the front wall. A viewing area is provided within the top of the housing through which at least a part of a display newspaper can be viewed. A newspaper display rack is mounted within the top of the housing under the viewing area at an angle from vertical ranging from about 40° to about 70°. The display rack has an upper surface through which at least a part of the display newspaper can be viewed.

In another embodiment, the invention is directed to a newspaper vending machine that has a newspaper access door that closes at a slowed rate and that can be opened to a wide angle. The newspaper vending machine comprises a housing having a front and a back and a storage compartment therein for storing a plurality of newspapers. A newspaper access door is pivotally mounted about a pivot point to the front of the housing to provide access to the storage compartment. The newspaper access door is rotatable about its pivot point over an angle of at least about 100°. The newspaper vending machine further comprises a door closing mechanism comprising a spring and a dampener. The spring is attached to the newspaper access door, whereby the spring builds up energy when the door is opened and exerts a closing force on the door. The dampener is directly or indirectly attached to the access door, whereby the dampener opposes the closing force of the spring, slowing the closing of the access door.

In still another embodiment, the invention is directed to a newspaper vending machine having an elevator mechanism for maintaining the newspapers at a relatively constant level with most of the newspapers contained within a storage compartment so that when a customer opens the newspaper access door to obtain a paper, the entire stack of papers is not easily accessible to the customer. The newspaper vending machine comprises a housing having a top and a bottom and a storage compartment therein for storing a plurality of newspapers. An elevator mechanism is provided at least partially within the storage compartment. The elevator mechanism comprises at least two stationary vertical shafts mounted in the housing and a platen slidably mounted on the shafts for holding a stack of newspapers having a particular weight. A compression spring is slidably mounted around each shaft to exert an upward force on the platen.

In another embodiment, the invention is directed to a newspaper vending machine having a newspaper access door for customer access to newspapers and a separate lid or door for refilling the machine with newspapers. The newspaper vending machine comprises a housing having an internal newspaper storage compartment and an opening for loading newspapers in the compartment. The machine further comprises a pivotal lid for closing the opening and a newspaper access door in the lid.

DESCRIPTION OF THE DRAWINGS

These and other features and advantages of the present invention will better understood by reference to the following detailed description when considered in conjunction with the accompanying drawings wherein.

DETAILED DESCRIPTION OF THE INVENTION

Figure 1:
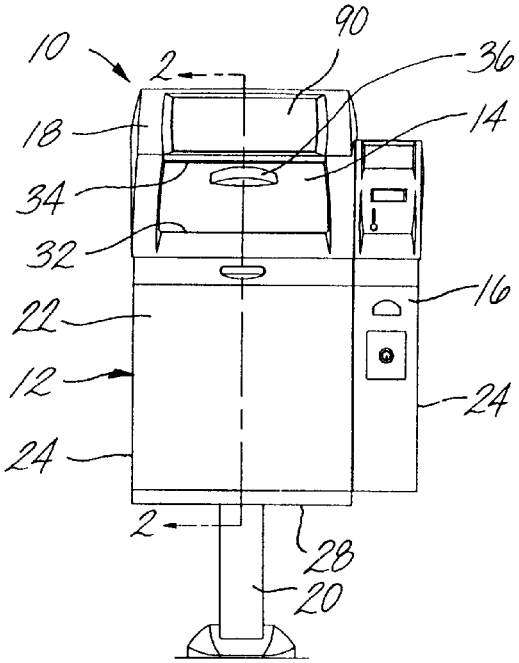
FIG. 1 is a front view of a newsrack according to the invention.
Figure 2:
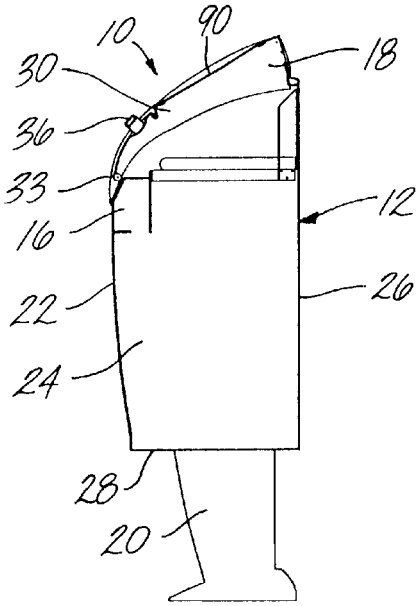
FIG. 2 is a side section view of the newsrack of FIG. 1 along line 2—2.
Figure 3:
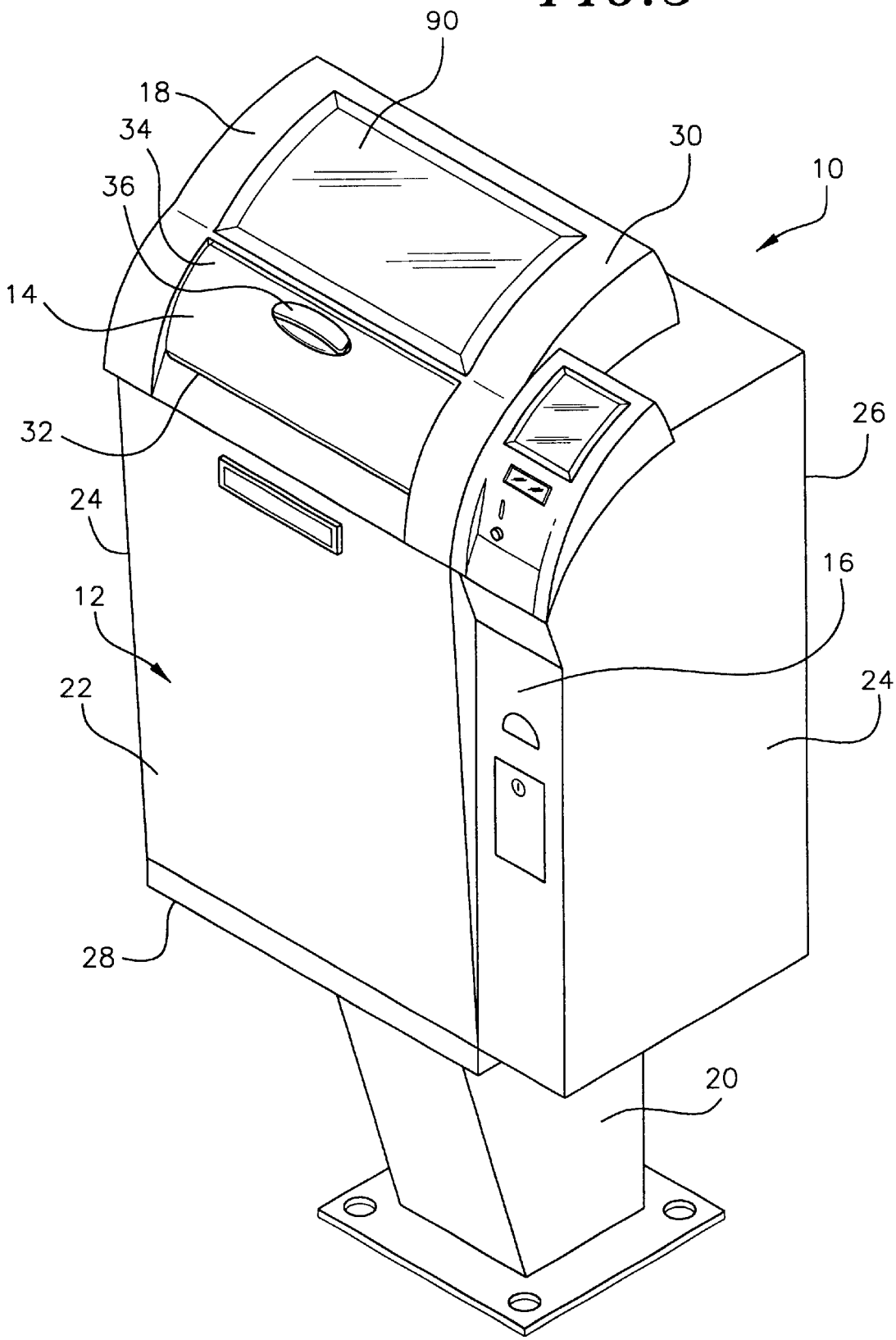
FIG. 3 is a three-quarter perspective view of a newsrack according to the invention.

The present invention is directed to a newspaper vending machine 10, commonly called a "newsrack". As shown in FIGS. 1 to 3, the vending machine 10 comprises a housing 12 having a newspaper access door 14, a coin box 16, and a newspaper display section 18. The housing 12 has a front wall 22, two side walls 24, a back wall 26, a bottom 28, and a generally curved top 30. The housing 12 is mounted on a pedestal 20 attached to the bottom 28 of the housing. Pedestal 20 can be bolted to the ground. Alternatively bottom 28 be mounted on a plurality of legs or with its bottom bolted directly to the ground, for example, by a skirt. The top of the newspaper vending machine 10 is the top of the top 30 of the housing 12 and the bottom of the newspaper vending machine is the point on the machine where is it mounted on the ground or to some other surface, e.g. the bottom of the pedestal 20.

The top 30 is generally curved downwardly toward the front wall 22 of the newspaper vending machine 10 so that the back edge of the top (i.e., where the top meets the back wall 26) is higher than the front edge of the top (i.e., where the top meets the front wall 22). The newspaper access door 14 and newspaper display section 18 are both located in the top 30. The newspaper access door 14 is mounted near the front of the top 30, preferably right above where the top meets the front wall 22.

Figure 7:
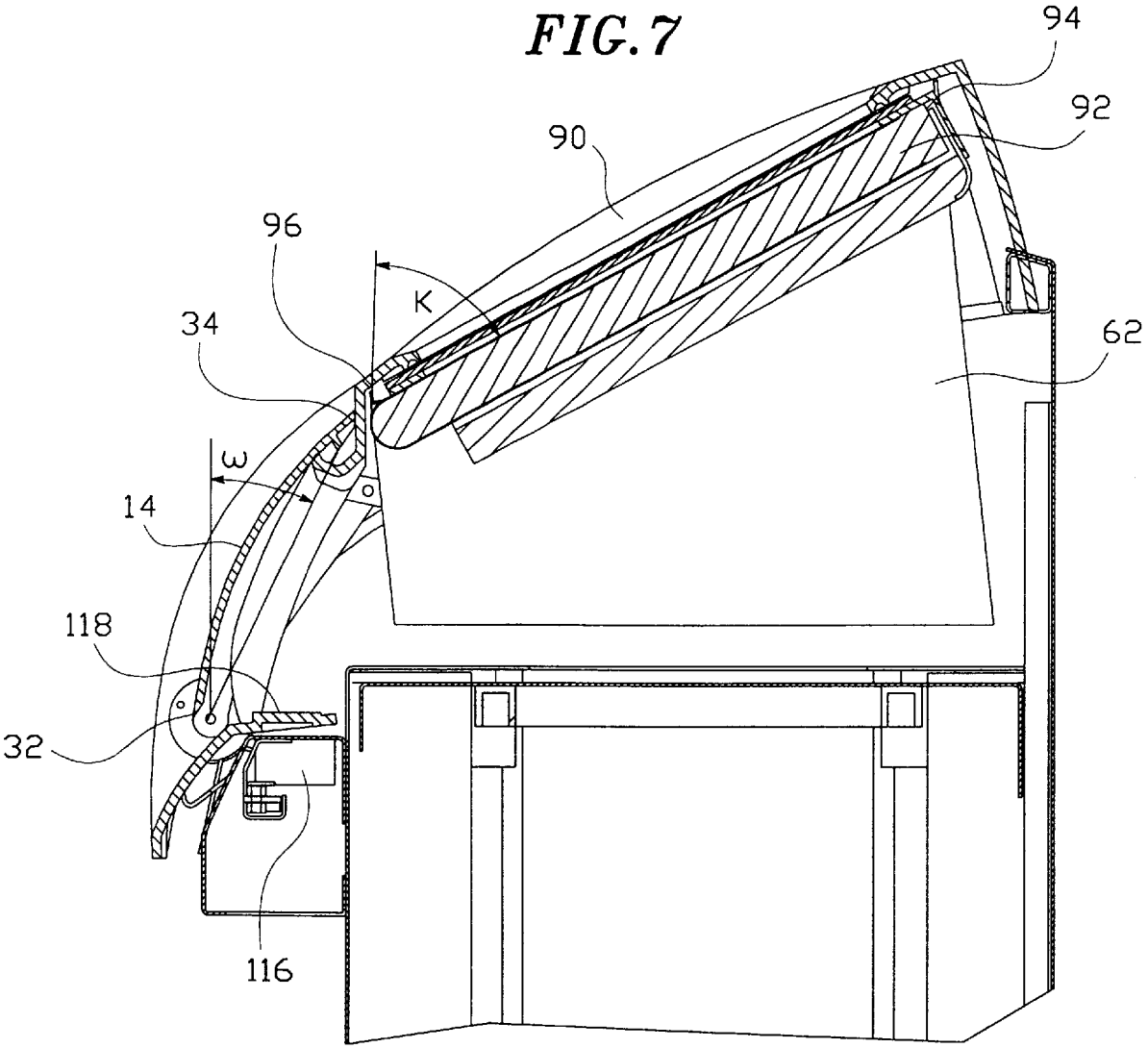
FIG. 7 is a side cross-sectional view of the top of a newsrack according to the invention showing the newspaper display rack and lid locking mechanism.

The newspaper access door 14 is generally rectangular when viewed from the front, as shown in FIG. 1, and slightly curved when viewed from the side to match the curve of the curved top 30, as shown in FIG. 4. As depicted in FIG. 1, the access door 14 has a lower edge 32 connected by a hinge 33 to the top 30 of the housing 12 and an upper edge 34 provided with a handle 36 for the customer to open the access door (i.e., pull the upper edge of the door away from the housing) to obtain access to newspapers contained within the housing. The access door 14 can be any other suitable shape, as would be recognized by one skilled in the art. Preferably the access door 14, in a closed position, is at an angle ω from vertical, as shown in FIG. 7. When the access door 14 is curved, the angle ω is measured based on the line from the pivot point of the door to the upper edge 34 of the door. The angle ω ranges from about 0° to about 45°, preferably from about 20° to about 30°, still more preferably about 25°. The opening provided by the access door 14 is generally small. Preferably the opening provided by the access door has a height ranging from about 4 to about 5 inches, and a width ranging from about 13 to about 15 inches. A generally small door and opening provides limited customer access to the newspapers, decreasing the likelihood of removal of multiple newspapers from the rack.

Figure 4A:
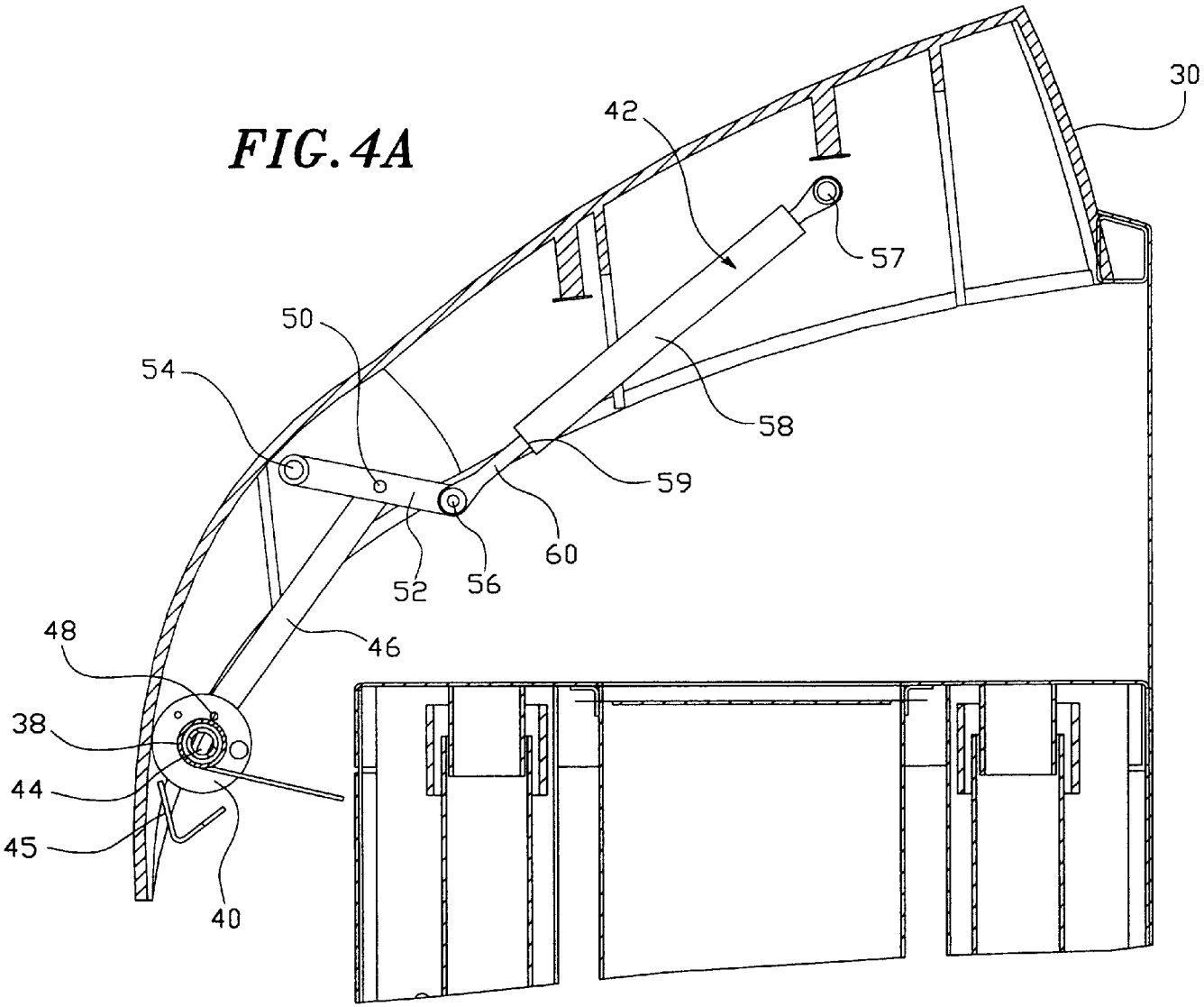
FIG. 4A is a side cross-sectional view of the top of a newsrack according to the invention showing the door closing mechanism.

A door closing mechanism is provided to facilitate closing of the newspaper access door 14 after it is opened by a customer. The door closing mechanism, depicted in FIGS. 4A, 4B and 5, generally comprises a torsion spring 38 having first and second ends and a dampening mechanism. The first end of the torsion spring 38 is attached to the access door 14 indirectly by connection to a rotatable cam 40 (described below) and at its second end to the inside of the top 30 of the housing 12 by a bracket 45. Thus, the first end of the torsion spring 38 moves with the access door 14 as it opens and closes, and the second end 37 of the torsion spring 38 is retained in a fixed position. FIG. 4A depicts the torsion spring 38 before it is attached to the inside of the top of the housing, i.e., with the spring at rest. Preferably the spring is preloaded (i.e., deformed) in its installed state to build up rotational energy, ensuring that the access door 14 closes tightly. FIG. 6 shows the second end 37 of the spring fixedly attached to the bracket 45.

When the user opens the access door 14, the torsion spring 38 is further deformed and builds up additional rotational energy. This rotational energy pulls the access door 14 closed when it is released by the user. The torsion spring 38 also provides resistance as the access door 14 is opened. If desired, more than one torsion spring can be used. For example, one torsion spring could be provided on each side of the access door, reducing the force required for each spring and balancing the application of this force.

In the depicted embodiment, the dampening mechanism comprises a rotatable cam 40, a dampener 42, and first and second linkages 46 and 52 connecting the rotatable cam to the dampener. The dampener 42 is preferably a gas dampener, such as model SD3000A sold by AVM (Marion, S.C.), although any other suitable dampener can be used. The dampener 42 generally comprises a cylinder 58 having a first closed end 57 and a second end 59 and a piston 60 slidably mounted in the second end of cylinder. The first end 57 of the cylinder is pivotally attached to the top 30 of the housing 12.

The torsion spring 38 is attached to the rotatable cam 40 by means of a shoulder screw 35 that is threaded into the cam to capture and fix the end of the torsion spring so that the spring will deform relative to the cam. The rotatable cam 40 is fixedly attached to the end of a hinge pin 44 that extends through the hinge 33 of the access door 14 so that the cam is concentric with the axis of the hinge pin and of the torsion spring 38. Accordingly, opening the access door 14 causes corresponding rotation of the rotatable cam 40. The first linkage 46 has a first joint 48 pivotally attached to the rotatable cam 40 and a second joint 50 pivotally attached to the second linkage 52. The second linkage 52 has a first joint 54 pivotally mounted to the inside of the top 30 of the housing 12 so it does not move (other than to pivot) as the access door 14 is opened and closed and a second joint 56 pivotally attached to the piston 60 of the dampener 42.

Figure 5:
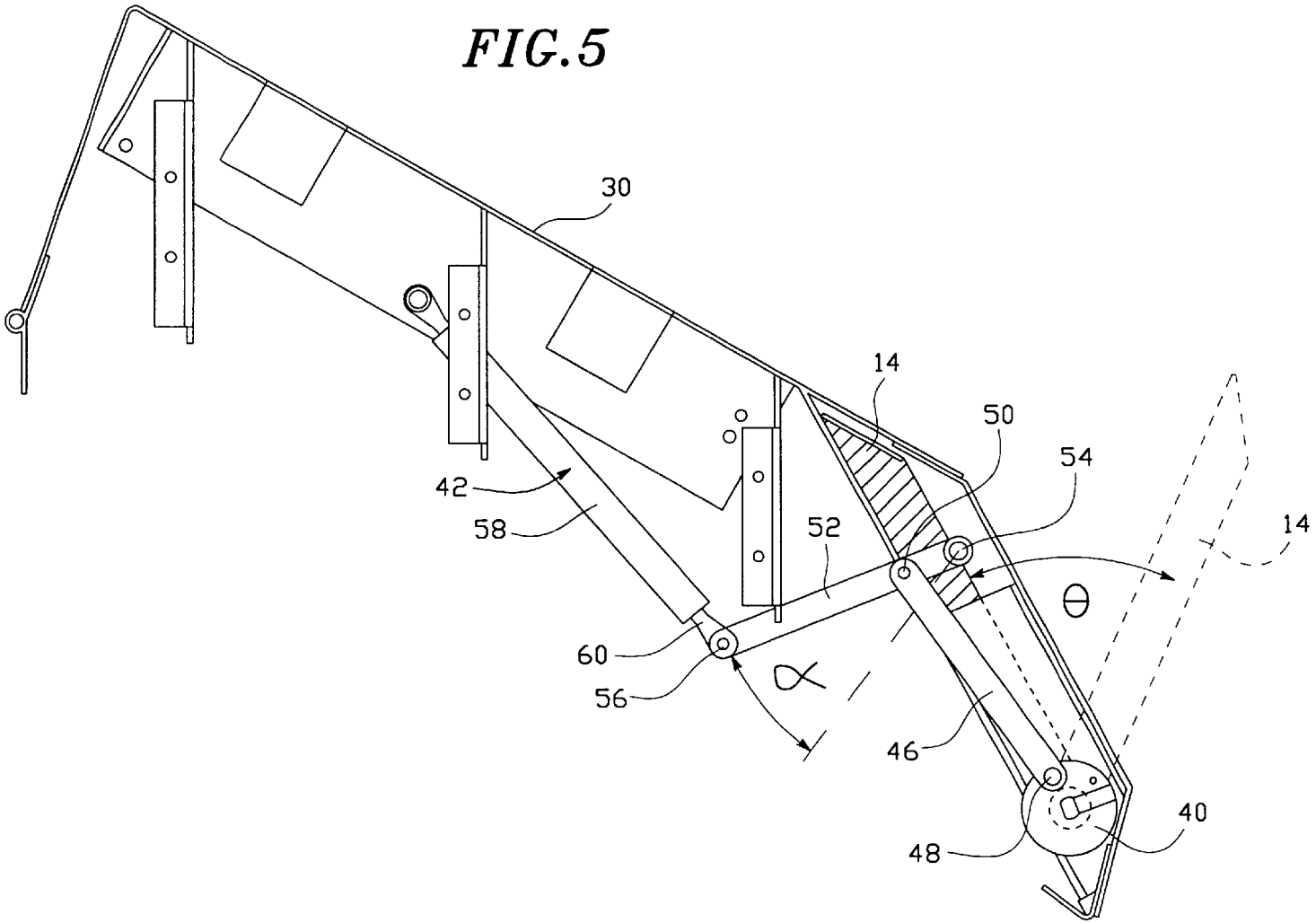
FIG. 5 is another side cross-sectional view of the top of a newsrack according to the invention showing an alternate view of the door closing mechanism.
Figure 6:
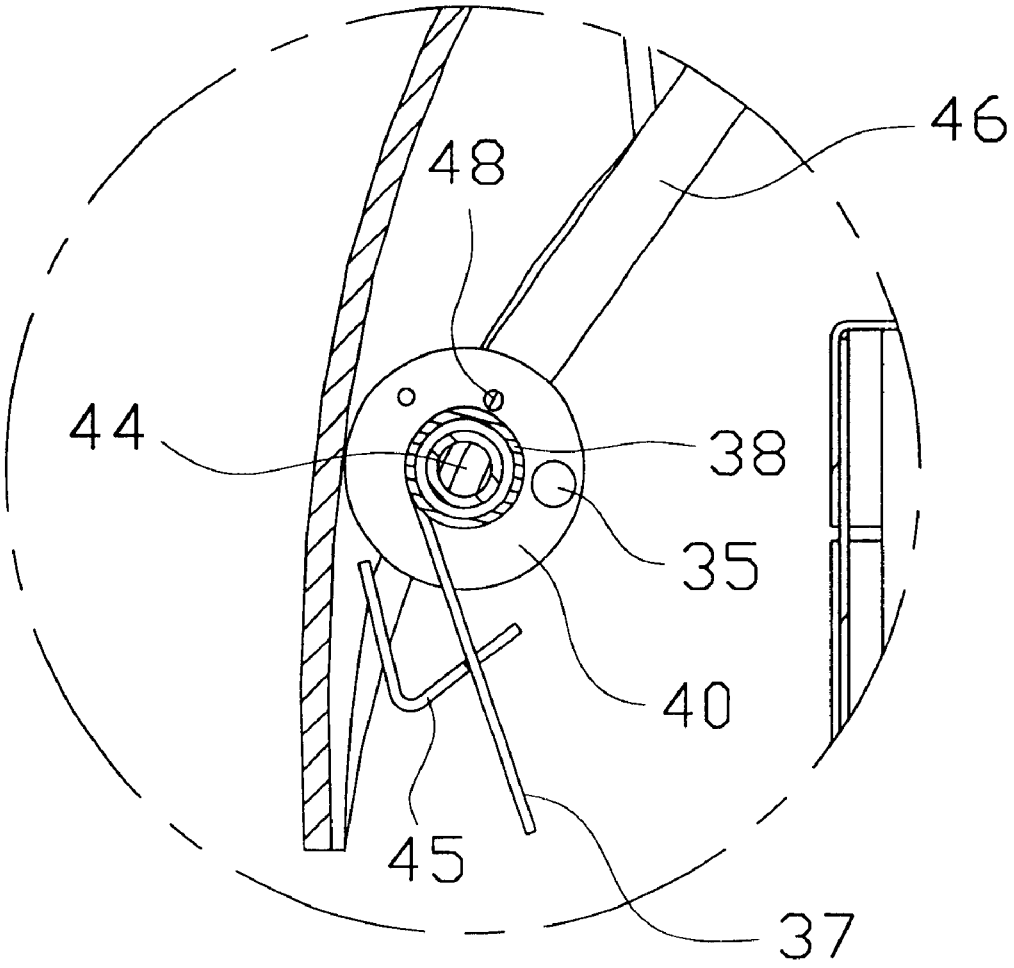
FIG. 6 is a close-up view of the torsion spring of the door closing mechanism shown in FIG. 4.

In use, with reference to FIG. 5, opening of the access door 14 causes rotation of the hinge pin 44 and attached cam 40 in a clockwise direction. As the cam 40 rotates in a clockwise direction, as viewed in FIG. 5, about the axis of rotation of the access door 14, i.e., about hinge pin 44, it correspondingly moves the first joint 48 of the first linkage 46 in a clockwise direction.

The first linkage 46 correspondingly pulls the second linkage 52 downward so that the second linkage pivots about its first joint 54 in a clockwise direction. The second joint 56 of the second linkage 52 thus pulls the piston 60 of the dampener 42 downward out of the cylinder 58.

When the user releases the access door 14, the rotational energy built up in the torsion spring 38 exerts a force on the door and pulls the door shut. Additionally, when the access door is at an angle $\omega$ from vertical greater than 0°, gravity assists in pulling the door shut. However, the dampening mechanism opposes this force, slowing the closing of the access door 14. Specifically, movement of the piston 60 into the cylinder 58 is slowed by the gas in the dampener 42, thus slowing rotation of the second linkage 52, which correspondingly slows movement of the first linkage 46, cam 40, hinge pin 44 and access door 14.

Thus, the rotational movement of the cam 40 is translated to linear movement by the first linkage 46. In this manner, as shown in FIG. 5, the angle $\alpha$ that the second linkage 52 travels about its first joint 54 is considerably less than the angle $\theta$ that the access door 14 travels about its hinge (which is the same as the angle that the cam 40 rotates about the hinge pin 44).

By this design, the access door 14 travels at a variable speed as it closes. Specifically, when the access door is fully opened it initially closes slowly and gains speed as it continues to close, effectively having a variable speed throughout its entire closing. As the access door 14 closes, the angle $\epsilon$ between the piston 60 and the second linkage 52 (shown in FIG. 4B) decreases, and thus the piston 60 travels a lesser distance into the cylinder 58 per degree of rotation of the door. Thus, as the access door 14 approaches the closed position, the dampening force decreases per degree of rotation of the door. This variation in speed is thus affected by the relative positioning of the dampener 42 and linkages 46 and 52.

Figure 4B:
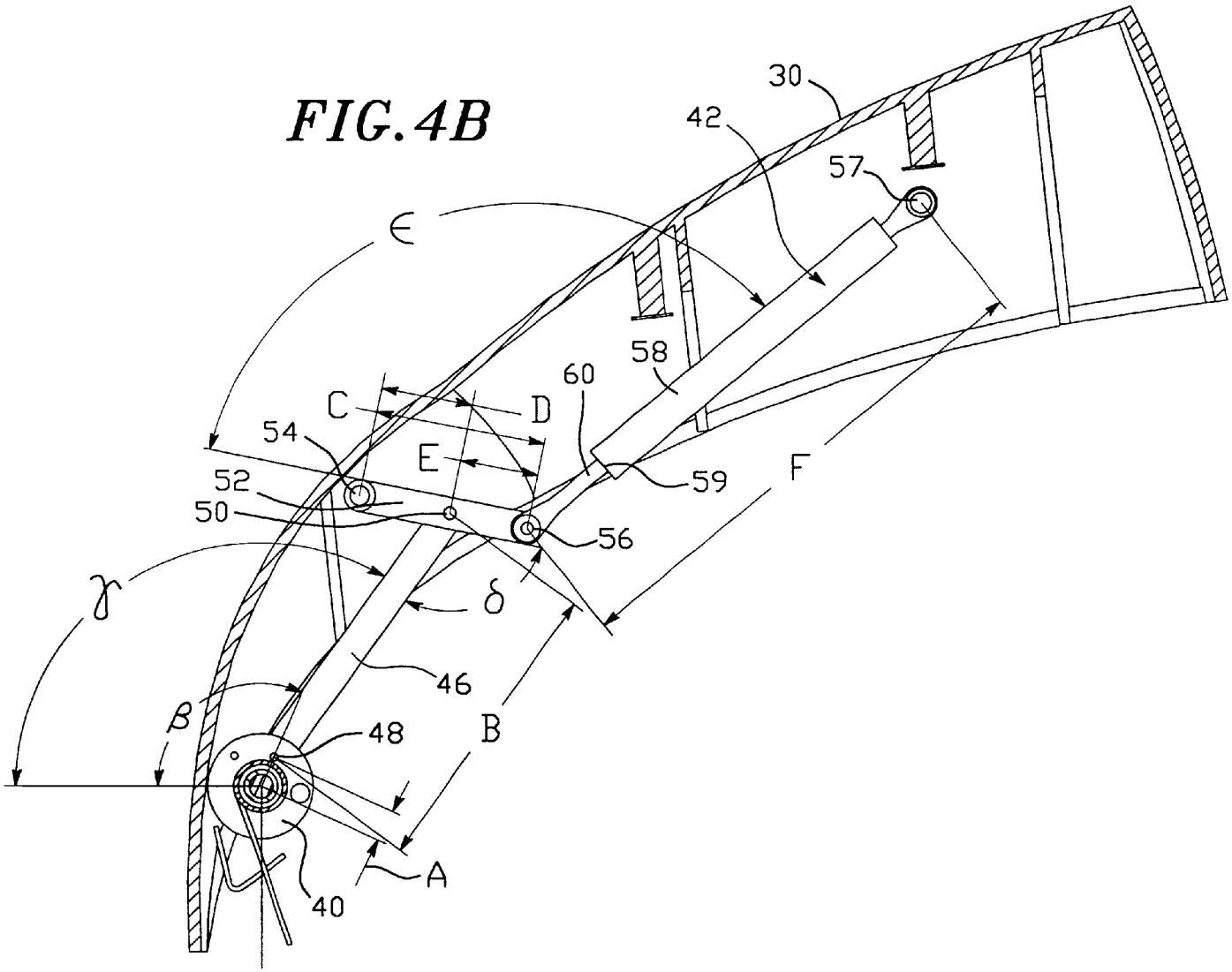
FIG. 4B is a close-up side cross-sectional view of the door closing mechanism depicted in FIG. 4A showing the relative positions, dimensions and angles of the components of the door closing mechanism.

A preferred arrangement of the dampening mechanism is shown in FIG. 4B, which is particularly preferred when the access door 14 is in the closed position and at an angle $\omega$ from vertical of about 25°. The cam 40 has a diameter of about 1 inch. The first linkage 46 is pivotally attached at its first joint 48 to the cam 40 a point on the cam that is at an angle $\beta$ from horizontal of about 114°. The first joint 48 of the first linkage 46 is attached to the cam 40 at an angle $\gamma$ from horizontal of approximately 126° and at a distance A from the axis of the cam of about 0.5 inch. The length B from the midpoint of the first joint 48 of the first linkage 46 to the midpoint of the second joint 50 of the first linkage is approximately 4.73 inches. The length C from the midpoint of the first joint 54 of the second linkage 52 to the midpoint of the second joint 56 of the second linkage is about 2.69 inches. The second joint 50 of the first linkage 46 is attached to a point along the length of the second linkage 52 that is a distance D from the midpoint of the first joint 54 the second linkage of approximately 1.45 inches and a distance E from the midpoint of the second joint 56 of approximately 1.24 inches. The first linkage 46 is attached to the second linkage 52 at an angle $\delta$ of approximately 114° in the closed position. The length F from the midpoint of the first joint 57 of the dampener 42 to the midpoint of the second joint 56 of the second linkage 52 (i.e., the joint of the second linkage and piston) when the dampener is in closed position is approximately 8.01 inches. The piston 60 of the dampener 42 is attached to the second joint 56 of the second linkage 52 at an angle $\epsilon$ of approximately 129°.

By this design, the access door 14 is capable of being closed slowly, i.e., by means of the dampening mechanism, after being opened to an angle $\theta$ of at least about 100°, more preferably at least about 130°, still more preferably at least about 150°, and even more preferably at least about 163° i.e., so that the upper edge 34 of the access door lies below the opening. By providing an access door that can open this far with a dampening mechanism, the newspaper vending machine 10 becomes more handicap accessible, i.e., it is easier for a person in a wheelchair reaching from a lower height than a person standing to obtain a newspaper, compared to a newspaper vending machine having a typical door that only opens up to a maximum of about 90° from vertical with a dampening mechanism.

This design also has the advantage that the entire door opening mechanism can be concealed from the customer, even when the access door 14 is opened. Specifically, the door opening mechanism is all positioned within the housing 12 to one side of the newspaper access door 14. As shown in FIG. 7, a wall 62 is mounted in the side of the top 30 of the housing 12 between the edge of the access door 14 and the door opening mechanism, thus blocking the mechanism from view.

In the above-described design, the dampener 42 is attached indirectly access door 14. If desired, the number of linkages between the cam 40 and dampener 42 can be altered. For example, the linkages can be eliminated so that the dampener 42 is attached directly to the cam 40 or directly to the access door 14, or reduced so that only one linkage connects the dampener to the cam. However, as explained above, the previously described dampening mechanism having two linkages is preferred because it permits the door to close at a variable speed. Additional linkages could also be provided as desired, for example, to fit the dampening mechanism in a particularly designed space.

Figure 8:
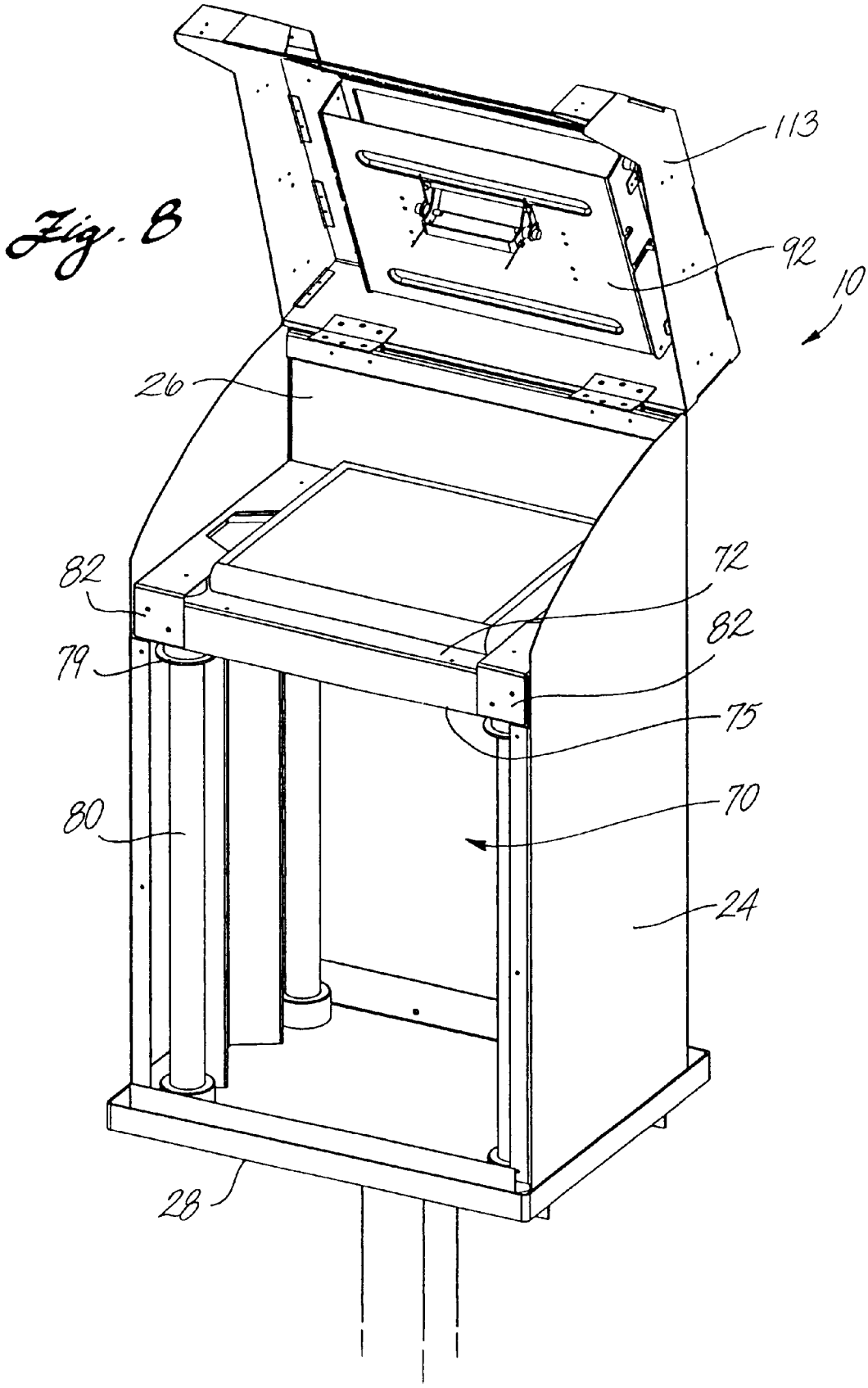
FIG. 8 is a three-quarter perspective view of a newsrack according to the invention with its lid open and its front wall removed.
Figure 9A:
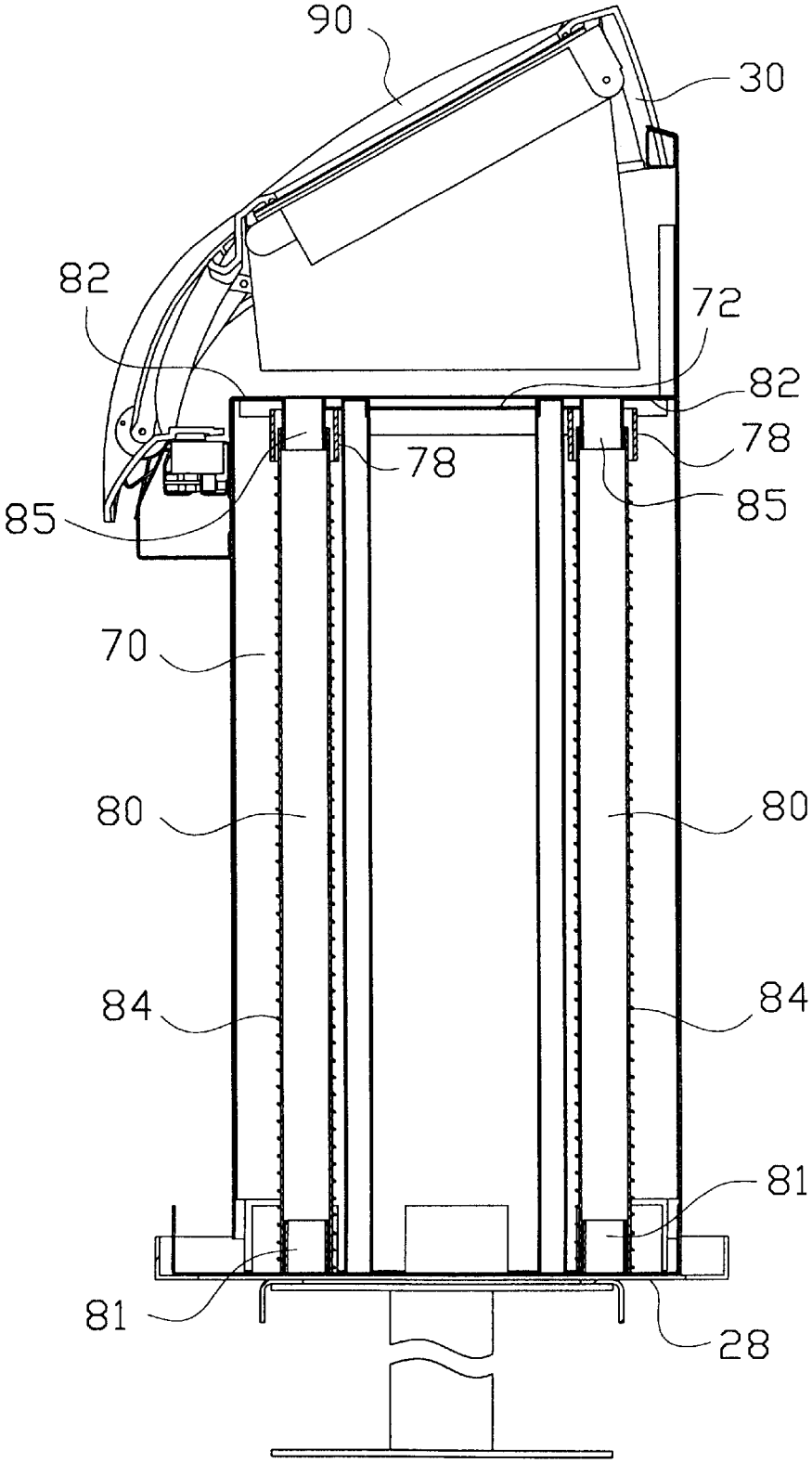
FIG. 9A is side cross-sectional view of a newsrack according to the invention showing the newspaper elevator mechanism with the platen at the top of the elevator mechanism.
Figure 9B:
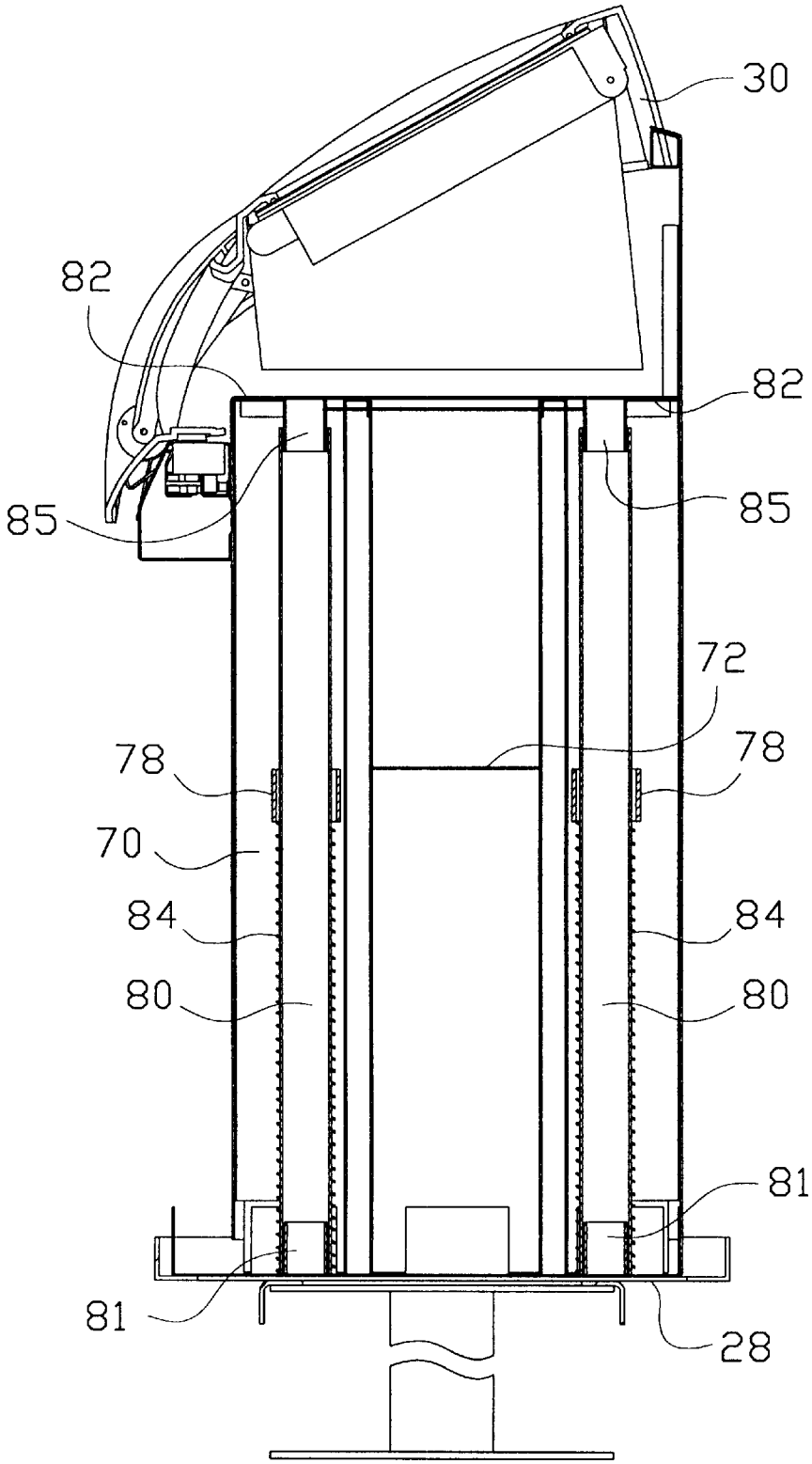
FIG. 9B is a side cross-sectional view of the newsrack according to FIG. 9A showing the platen lowered on the elevator mechanism.
Figure 10:
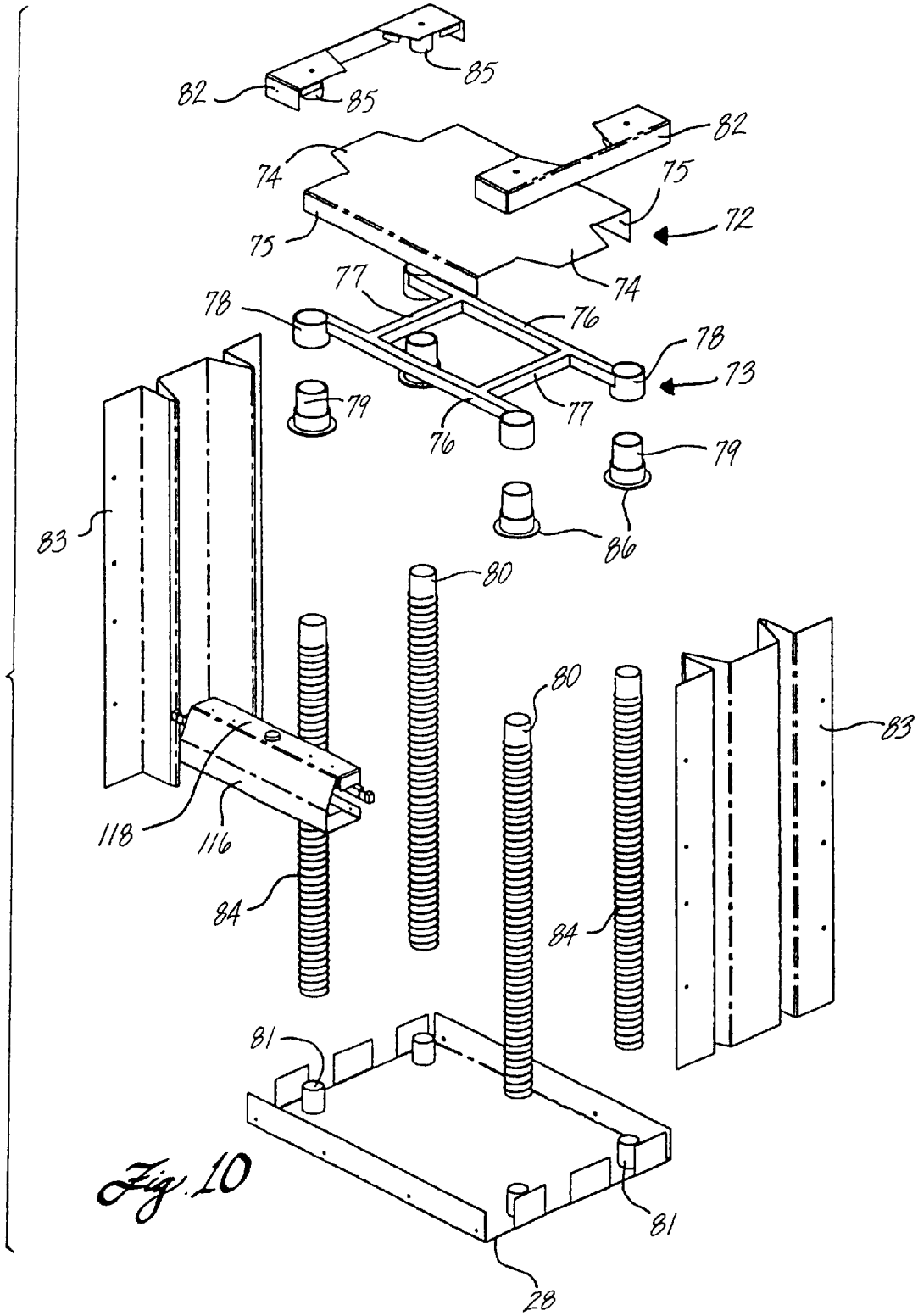
FIG. 10 is an exploded view of a preferred elevator mechanism for a newsrack according to the invention.

The lower part of the housing 12 contains a storage compartment 70 in which the newspapers are stored, as shown in FIGS. 8, 9A and 9B. So that the newspapers are dispensed one at a time, an elevator mechanism is provided within the housing 12, which provides an upward biasing force to the newspapers remaining in the storage compartment as the newspapers are removed. As shown in FIG. 10, the elevator mechanism includes a platen comprising a platen cover 72 (or tray) fixedly mounted, e.g., with screws, rivets or the like, on a platen frame 73, which is slidably mounted on four stationary shafts 80. The newspapers are stacked on the platen cover 72, which is preferably generally rectangular, having a length and width size slightly smaller than the length and width of the housing 12. The platen cover 72 has two arms 74 extending outwardly from two opposing sides of the cover and two flanges 75 extending downwardly from the other two opposing sides of the cover. The platen frame 73 comprises two opposing lengthwise arms 76 and two opposing widthwise arms 77 in perpendicular relation to the lengthwise arms. Four tubular collars 78 are mounted on the ends of each of the lengthwise arms 76, thus forming holes in the platen. Each collar 78 is in vertical alignment with a different shaft 80 so that the platen cover 72 and frame 73 can be slidably mounted on the shafts.

The shafts 80 are generally tubular, having an open interior, and are preferably made of stainless steel. The shafts 80 are fixedly mounted at their bottom ends to the bottom 28 of the housing 12 by means of four tubular upward-facing pegs 81 that extend into the bottom ends of the shafts 80. The shafts 80 are mounted at their top ends to one of two mounting brackets 82. The mounting brackets 82 are fixedly attached to side panels 83 of the elevator mechanism. The side panels 83 are also secured to the bottom 28 of the housing 12. Each mounting bracket 82 has two downward-facing pegs 85 that extend into the top ends of the shafts 80 to fixedly mount the shafts to the mounting brackets.

A bushing 79 is inserted in each of the collars 78 to enhance the ability of the collars to slide vertically along the shafts 80. The bushings 79 each have a cylindrical passage through which one of the shafts 80 extends. As a result, the platen rides up and down as newspapers are unloaded and loaded. The bushings 79 also each have an outer spring-retaining flange 86 at their bottom edges. The bushings 79 and shafts 80 are designed so that the bushings are tightly toleranced to the shafts. This prevents sideways motion or tipping of the platen cover 72 and frame 73. When the shafts 80 are made of stainless steel, the bushings 79 are preferably made of nylon or the like. In a particularly preferred embodiment, each bushing 79 has an inner diameter of about 1.515 inches and each shaft 80 has an outer diameter of about 1.500 inches. Each compression spring 84 is retained between flange 86 and the surface of the bottom 28 of the housing 12.

A compression spring 84 surrounds each shaft 80. FIGS. 9A and 9B show side cross-sectional views of the elevator mechanism taken through, for example, the mounting bracket 95, arm 74 of the platen cover 72, and shafts 80. When there are no newspapers on the platen cover 72, the cover and frame 73 sit at the top of the shafts 84 (as shown in FIG. 9A), as there is little force being exerted on the four compression springs 84. As newspapers are placed on the platen cover 72, the weight of the newspapers exerts a downward force on the springs 84, enabling the platen cover and frame to slide downward on the shafts 80, as shown in FIG. 9B. Preferably, the force of the springs 84 is matched to the weight of the newspapers so that the top newspaper on the stack is always approximately in the same vertical position. The use of compression springs rather than expansion springs increases the stability of the platen cover 72. The stability of the platen cover is further enhanced by the use four shafts 80 to confine these compression springs 84.

The newspaper display section 18 of the vending machine is in the top 30 of the housing 12, above the newspaper access door 14. As discussed above, the top 30 is generally curved downwardly toward the front of the newsrack 10 so that the back of the top is higher than the front of the top. As shown in FIGS. 1 and 3, the newspaper display section 18 comprises a clear display window 90, for example, made of glass or plastic, through which a display newspaper can be viewed. The window 90 has a size approximately equal to half the size of the front page of a newspaper and preferably has a height of about 9.5 inches and a width of about 12 inches. Within the housing 12, the display newspaper is contained in a display rack 92 mounted below the display window 90, as shown in FIG. 7. As depicted in FIGS. 7, 8, 11, and 12, the display rack 92 comprises a generally rectangular box having a top end 94 and a bottom end 96. The display rack 92 further comprises an upper tray 98 that forms an upper surface of the rack, a lower tray 100 that forms a lower surface of the rack, and paper tray 102 between the upper tray and lower tray. The upper tray 98, lower tray 100 and paper tray 102 are all generally rectangular. The trays 98, 100 and 102 are connected at the top end 94 of the rack by a top wall 104 and are enclosed at their sides by side walls 106, but are not connected at the bottom end 96 of the rack. The lower tray 100 is rotatably attached to the back wall 104 to permit opening of the display rack, as described in more detail below. The display rack 92 has a size slightly larger than a newspaper. A particularly preferred display rack is about 14 inches wide, about 12.5 inches high, and about 2 inches thick. The display rack 92 can be mounted in the top 30 of the housing 12 by any suitable means, for example, by a plurality of brackets 107 connected to the side walls 106 of the rack.

A display paper is mounted in the display rack 92 between the upper tray 98 and the paper tray 102. The bottom end of the paper tray 102 contains two angled flanges 108 that prevent the display paper from sliding out the bottom end 96 of the rack because the rack is maintained at an angle, as discussed in more detail below. The upper tray 98 contains a generally rectangular opening 99, preferably the same size as the clear window 90, so that the display newspaper in the display rack can be viewed through the window. The distance between the paper tray 102 and upper tray 98 can be varied depending on the thickness of the display paper. Specifically, two leaf springs (not shown) are mounted on the lower tray 100 to bias the paper tray 102 upward toward the upper tray 98 to maintain the display paper tightly between the trays.

The display rack 92 is maintained within the top 30 of the housing 12 at a height and at an angle κ from vertical (as shown in FIG. 7) that permits the user to easily read the display paper from a standing position, as if standing in front of a podium or lectern, in contrast to traditional newspaper vending machines having a vertically-displayed newspaper at a lower height. Preferably the bottom end 96 of the display rack 92 is at a height of from about 40 to about 46 inches, more preferably about 44 inches, from the ground or surface on which the newspaper vending machine stands. The angle κ preferably ranges from about 40° to about 70°, more preferably about 55° to about 65°, still more preferably about 60°, from vertical.

When the last newspaper in the storage compartment 70 is sold, the customer then has the opportunity to purchase the display newspaper in the display rack 92. The bottom end of the paper tray 102 has an opening 112, preferably semi-circular, through which the customer can see and reach the display newspaper.

Figure 11:
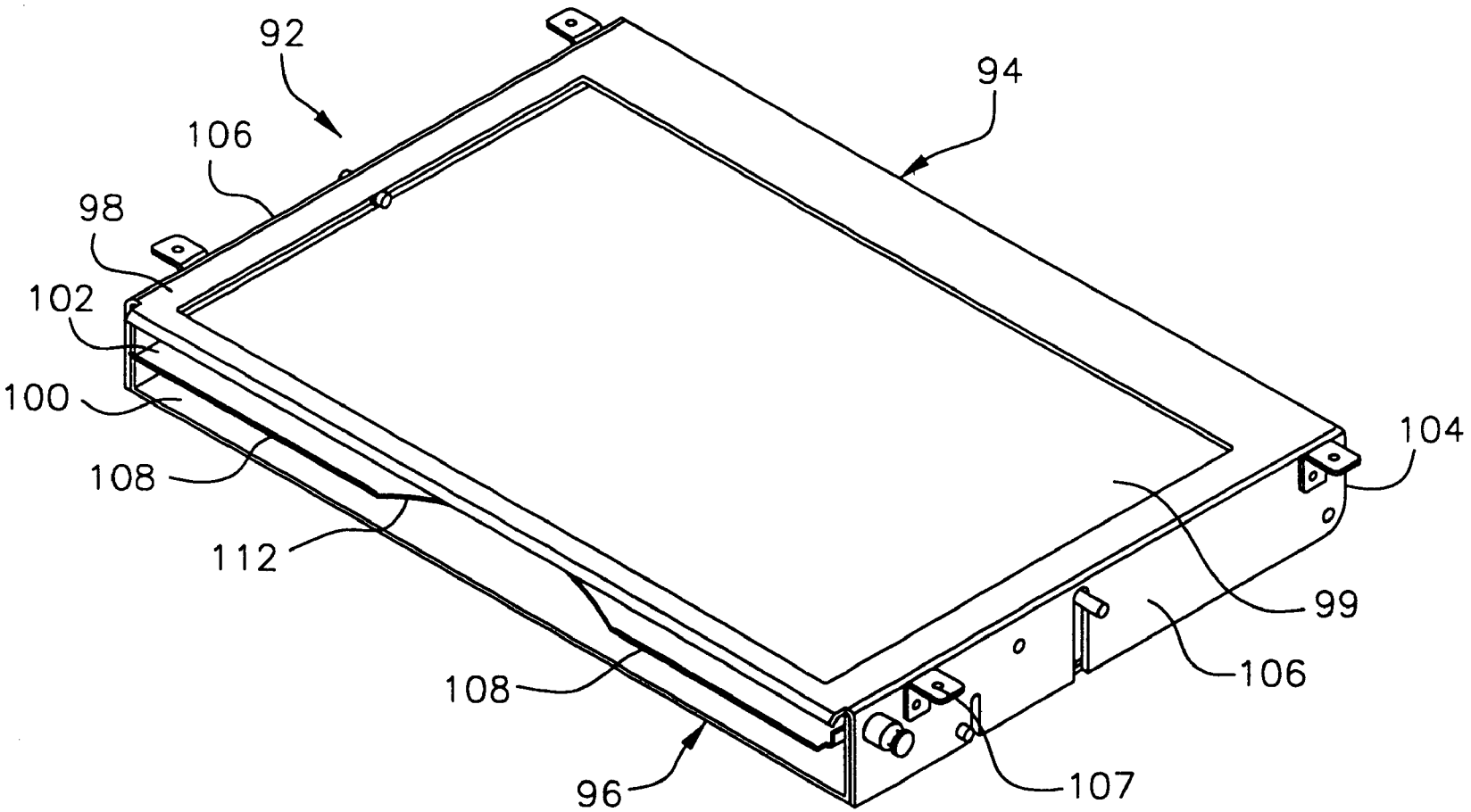
FIG. 11 is a three-quarter perspective view of the top side of a newspaper display rack according to the invention.
Figure 12:
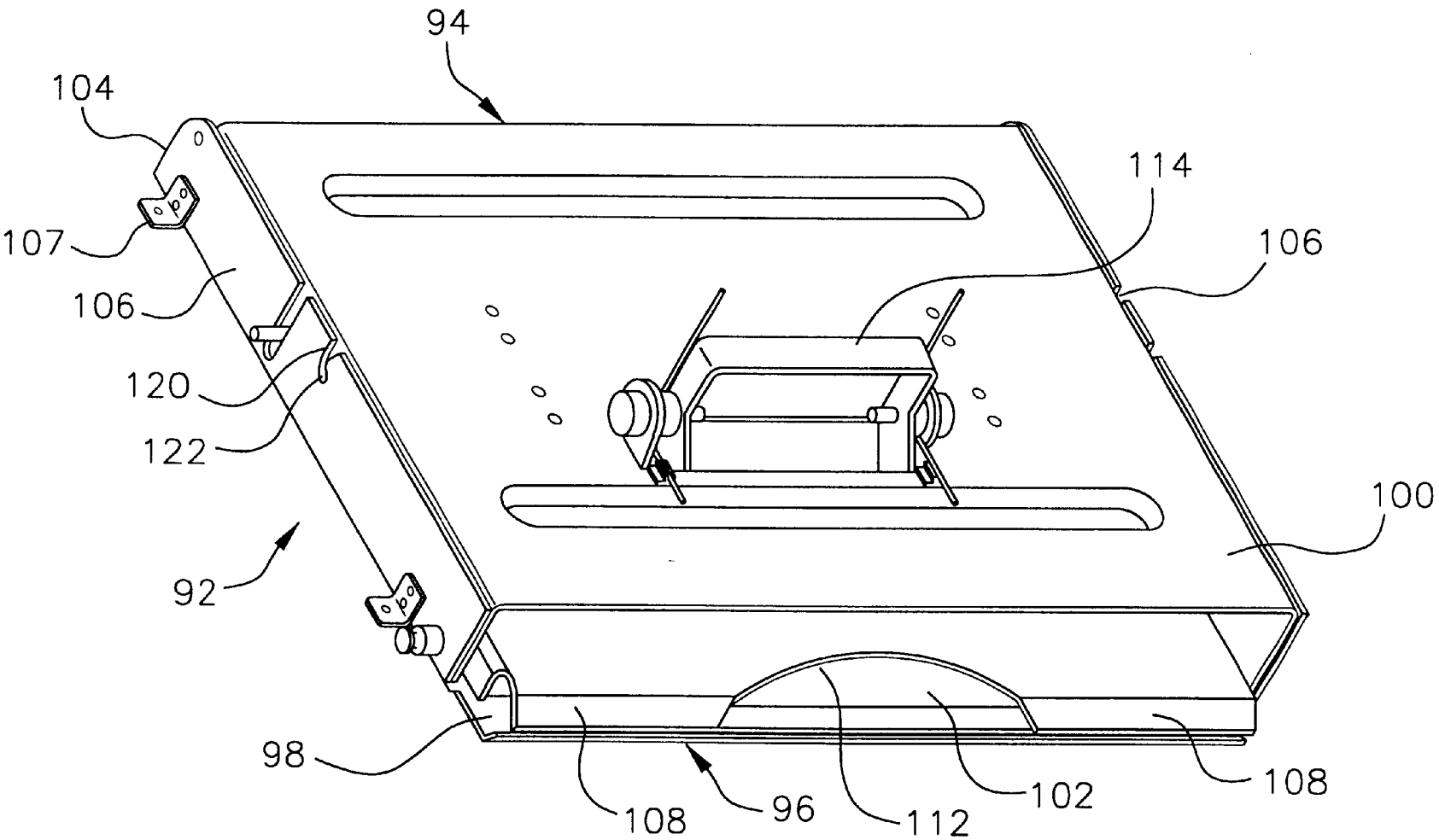
FIG. 12 is a three-quarter perspective view of the bottom side of a newspaper display rack according to the invention.

The present invention also provides convenience in refilling the newspaper rack. Specifically, the top 30 of the housing 12 is hinged to the back wall 26 of the housing, thereby forming a lid 113, so that the top can be opened from the front side of the rack, as shown in FIG. 8. By this design, newspapers can be removed and added through the lid rather than through the relatively small access door 14 and associated opening. Alternatively, the access door 14 can be mounted elsewhere on the housing 12, e.g., on the front wall 22 of the housing. The access door 14 is located within the lid 113 below the newspaper display section 18, as shown. The access door 14 located within the newspaper loading lid results in a particularly compact design. For security purposes, the lid 113 is locked in place to the housing. As shown in FIGS. 7 and 11, a lock mechanism 116 having a lock plate 118 on its top is provided on the front of the housing 12, just below the lid 113. To refill the papers in the newsrack 10, a user opens the newspaper access door 14 by putting a coin in the coin mechanism, discussed below. When the access door 14 is opened, the lock plate 118, which is just below the bottom of the access door, is accessible. The user can unlock the lid 113 by inserting a key in the lock plate 118. The user can then lift the lid 113, providing easy access to the platen on which the newspapers are stacked.

The display newspaper can also be easily replaced. A handle 114 is attached to the lower tray 100 of the display rack 92. On each side wall 106 of the display rack 92 is an L-shaped groove 120 having a vertical section and horizontal section. A pin 122 extends out of the groove. When the lower tray 100 is in a closed or "locked" position, the pin 122 sits in the horizontal section of the groove 120. To refill the display rack, the user opens the newspaper access door 14 to obtain access to the handle 114 of the display rack 92. The user rotates the handle 114 toward the bottom end 96 of the rack 92, which in turn moves the pin 122 from the horizontal section of the groove 120 to the vertical section of the groove, permitting the lower tray 100 to be opened.

Opening of the access door 14 is controlled by a coin mechanism (not shown) located in the coin box 16. The coin mechanism can be of any construction whereby a particular number or combination of coins is inserted into a coin slot to actuate the mechanism and permit opening of the access door 14. As is known in the art, insertion of the proper coin combination will move a bolt or latch (not shown) that engages a strike (not shown) on the side of the access door. If desired, the coin box 16 and coin mechanism can be replaced or supplemented with a mechanism for accepting paper currency and/or a mechanism for accepting credit and/or debit cards. The coin box 16 or other part of the housing can further include a liquid crystal display for providing information to the customer, such as the cost of the newspaper.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A newspaper vending machine comprising:

a housing having a top, a bottom, and a storage compartment therein for storing a plurality of newspapers;

a viewing area within the top through which at least a part of a display newspaper can be viewed; and means for mounting the display newspaper so that at least a portion of the display newspaper can be seen through the viewing area and so that the newspaper is mounted at an angle from vertical ranging from about 40° to about 70°.

2. A newspaper vending machine comprising:

a housing having a top, a bottom, and a storage compartment therein for storing a plurality of newspapers;

a viewing area within the top through which at least a part of a display newspaper can be viewed; and a newspaper display rack mounted within the housing under the viewing area at an angle from vertical ranging from about 40° to about 70°, the display rack having an upper surface through which at least a part of the display newspaper can be viewed.

3. A newspaper vending machine according to claim 2, wherein the display rack is mounted within the housing at an angle from vertical ranging from about 55° to about 65°.

4. A newspaper vending machine according to claim 2, further comprising means for mounting the housing on a surface.

5. A newspaper vending machine according to claim 4, wherein the display rack has a top end and a bottom end, the bottom end being at a height ranging from about 40 to about 46 inches from the surface on which the machine is mounted.

6. A newspaper vending machine according to claim 2, wherein the machine has a top and a bottom and the display rack has a top end and a bottom end, the bottom end being at a height ranging from about 40 to about 46 inches from the bottom of the machine.

7. A newspaper vending machine according to claim 2, further comprising a newspaper access door in the top of the housing below the viewing area.

8. A newspaper vending machine according to claim 2, wherein the housing further comprises a front wall, a back wall and two side walls.

9. A newspaper vending machine according to claim 8, wherein the top of the housing is generally curved downwardly toward the front wall, whereby the portion of the top in contact with the back wall is higher than the portion of the top in contact with the front wall.

10. A newspaper vending machine comprising:

a housing having a front wall, a back wall, two side walls, a top, and a bottom, and a storage compartment therein for storing a plurality of newspapers, wherein the top of the housing is generally curved downwardly toward the front wall, whereby the portion of the top in contact with the back wall is higher than the portion of the top in contact with the front wall;

a viewing area within the top through which at least a part of a display newspaper can be viewed; and a newspaper display rack mounted within the top of the housing under the viewing area at an angle from vertical ranging from about 40° to about 70°, the display rack having an upper surface through which at least a part of the display newspaper can be viewed.

11. A newspaper vending machine comprising:

a housing having a front and a back and a storage compartment therein for storing a plurality of newspapers;

a newspaper access door pivotally mounted about a pivot point to the front of the housing to provide access to the storage compartment, the newspaper access door being rotatable about its pivot point over an angle of at least about 100°; and a door closing mechanism comprising:

a spring attached to the newspaper access door, whereby the spring builds up energy when the door is opened and exerts a closing force on the door; and a dampener directly or indirectly attached to the access door, whereby the dampener opposes the closing force of the spring, slowing the closing of the access door.

12. A newspaper vending machine according to claim 11, wherein the newspaper access door is rotatable about its pivot point over an angle of at least about 130°.

13. A newspaper vending machine according to claim 11, wherein the newspaper access door is rotatable about its pivot point over an angle of at least about 150°.

14. A newspaper vending machine according to claim 11, wherein the newspaper access door is rotatable about its pivot point over an angle of at least about 163°.

15. A newspaper vending machine according to claim 11, wherein the spring is a torsion spring.

16. A newspaper vending machine according to claim 11, wherein the door opening mechanism is concealed from the view of a customer when the newspaper access door is open.

17. A newspaper vending machine according to claim 11, wherein the door closing mechanism further comprises:

a rotatable cam having an axis, the cam mounted to the access door so that the axis of the cam is concentric with the axis of the access door;

a first linkage having first and second ends, wherein the first end is pivotally attached to the rotatable cam;

a second linkage having first and second ends, wherein the first end of the second linkage is pivotally attached to the housing;

wherein the second end of the second linkage is pivotally attached to the dampener and the second end of the first linkage is pivotally attached to the second linkage.

18. A newspaper vending machine comprising a housing having a top and a bottom and a storage compartment therein for storing a plurality of newspapers;

an elevator mechanism at least partially within the storage compartment, the elevator mechanism comprising:

at least four stationary vertical shafts mounted in the housing;

a platen slidably mounted on the shafts for holding a stack of newspapers having a particular weight;

a compression spring slidably mounted around each shaft, wherein each compression spring exerts an upward force on the platen.

19. A newspaper vending machine according to claim 18, wherein the force exerted by the compression springs is matched to the weight of the newspapers on the platen so that, as newspapers are removed from the platen, the newspaper on the top of the stack is always in approximately the same vertical position.

20. A newspaper vending machine according to claim 18, wherein the platen has a plurality of holes therethrough through which the shafts extend for slidably mounting the platen on the shafts.

21. A newspaper vending machine according to claim 20, wherein the platen further comprises a bushing in each hole to enhance the ability of the platen to slide vertically along the shafts.

22. A newspaper vending machine according to claim 18, wherein the platen comprises:

a platen frame comprising a plurality of tubular collars, wherein the each collar is in vertical alignment with a corresponding shaft;

a platen cover mounted on the platen frame for receiving a stack of newspapers.

23. A newspaper vending machine according to claim 22, wherein the platen further comprises a bushing in each collar to enhance the ability of the platen to slide vertically along the shafts.

24. A newspaper vending machine comprising:

a housing having a front wall, a back wall, two side walls, and a bottom, and a storage compartment therein for storing a plurality of newspapers, a lid mounted on the housing and pivotally attached to the back wall of the housing, the lid being generally curved downwardly toward the front wall, whereby the portion of the lid in contact with the back wall is higher than the portion of the top in contact with the front wall, wherein the lid provides a first opening through which a user can access at least a part of the storage compartment; and a newspaper access door mounted on the lid for providing a second opening through which a user can access at least a part of the storage compartment;

wherein the first opening is larger than the second opening.

* * * * *